US009951516B2

(12) United States Patent
Millhouse et al.

(10) Patent No.: US 9,951,516 B2
(45) Date of Patent: Apr. 24, 2018

(54) BLOWN INSULATION APPARATUS AND METHOD

(71) Applicants: James Stephen Millhouse, Walden, NY (US); Michael James Furman, Central Valley, NY (US)

(72) Inventors: James Stephen Millhouse, Walden, NY (US); Michael James Furman, Central Valley, NY (US)

( * ) Notice: Subject to any disclaimer, the term of this patent is extended or adjusted under 35 U.S.C. 154(b) by 0 days.

(21) Appl. No.: 15/237,118

(22) Filed: Aug. 15, 2016

(65) Prior Publication Data

US 2016/0348355 A1 Dec. 1, 2016

Related U.S. Application Data

(63) Continuation of application No. 14/510,056, filed on Oct. 8, 2014, now Pat. No. 9,416,531.

(60) Provisional application No. 61/888,343, filed on Oct. 8, 2013.

(51) Int. Cl.

| | |
|---|---|
| ***E04B 1/76*** | (2006.01) |
| ***E04B 1/74*** | (2006.01) |
| ***E04D 13/16*** | (2006.01) |
| ***E04B 1/78*** | (2006.01) |

(52) U.S. Cl.

CPC ..... *E04B 1/7604* (2013.01); *E04B 1/78* (2013.01); *E04D 13/1625* (2013.01); *E04D 13/1675* (2013.01); *E04B 2001/742* (2013.01)

(58) Field of Classification Search

USPC ..... 52/404.1, 404.2, 404.3, 406.1, 742.13, 52/407.4

See application file for complete search history.

(56) References Cited

U.S. PATENT DOCUMENTS 2,989,790 A * 6/1961 Brown ..... E04B 1/7604 52/742.13
3,531,901 A * 10/1970 Will, Jr. ..... E04B 1/762 100/223
4,103,464 A * 8/1978 Clifft ..... E04F 13/02 141/311 R
4,446,665 A * 5/1984 Berger ..... E04D 3/3602 52/407.4
4,712,347 A * 12/1987 Sperber ..... E04B 1/7604 52/404.1
4,875,320 A * 10/1989 Sparkes ..... E04D 13/1625 52/22

(Continued)

*Primary Examiner* — Joshua J Michener
*Assistant Examiner* — Kyle J. Walraed-Sullivan
(74) *Attorney, Agent, or Firm* — Calhelha & Doyle, LLC

(57) ABSTRACT

The subject apparatus is designed to facilitate the installation of blown insulation during construction of building assemblies. In a typical embodiment, there is provide a length or strip of friction clip configured to provide a tight grip along the outer surface of a framing member such as a stud, thereby maintaining tension on a masking film or web thereby affixed to an array of studs. The masking film arrayed in such manner thereby defines a plurality of voids or cavities which may thereafter be filled with blown insulation and then finished with wall paneling. The friction clips are designed to complement conventional framing members. Thus, one embodiment described below is suitable for a solid stud such as lumber or polymer; other embodiments are designed to be affixed to steel light framing members such as C-studs and similar profiles.

14 Claims, 9 Drawing Sheets

(56) References Cited

U.S. PATENT DOCUMENTS 5,365,716 A * 11/1994 Munson ..... E04B 1/7604 52/404.1
5,701,709 A * 12/1997 Dixon, III ..... E04B 1/7604 52/404.1
6,047,518 A * 4/2000 Lytle ..... E04F 21/085 156/78
6,161,361 A * 12/2000 Ehrenkrantz ..... E04C 3/291 52/834
6,226,943 B1 * 5/2001 Grinshpun ..... E04B 1/80 52/309.4
6,487,825 B1 * 12/2002 Sillik ..... E04B 1/7666 248/343
8,365,490 B2 * 2/2013 Kinzler ..... E04D 13/1625 52/361
8,367,195 B2 * 2/2013 Santoro ..... C04B 28/001 428/15
9,416,531 B1 * 8/2016 Millhouse ..... E04B 1/7604
2002/0073641 A1 * 6/2002 Menchetti ..... E04B 2/7411 52/404.1
2002/0132080 A1 * 9/2002 Hendriks ..... E04B 1/76 428/61
2003/0167718 A1 * 9/2003 Alderman ..... E04D 13/1618 52/407.3
2004/0148889 A1 * 8/2004 Bibee ..... E04B 1/78 52/481.1
2007/0090267 A1 * 4/2007 Sillik ..... E04B 1/7666 248/510
2008/0000170 A1 * 1/2008 Tamlyn ..... E04D 12/002 52/22
2008/0184643 A1 * 8/2008 Foster ..... E04B 2/7457 52/404.2
2014/0026508 A1 * 1/2014 Niemann ..... E04B 1/165 52/405.3
2014/0102026 A1 * 4/2014 McClure ..... E04F 13/0823 52/404.3

* cited by examiner 76
75
72

76
75
74

75
77
72
76
74

75
77
75
76
72
74

BLOWN INSULATION APPARATUS AND METHOD

CROSS-REFERENCE TO RELATED APPLICATIONS

This application is a continuation of application Ser. No. 14/510,056 filed Oct. 8, 2014 and claims the benefit of provisional application Ser. No. 61/888,343 filed Oct. 8, 2013. These applications are incorporated herein by reference.

FIELD OF THE INVENTION

The present invention relates to a method of installing blown insulation and an apparatus for facilitating such installation.

BACKGROUND OF THE INVENTION

In building construction and remodeling, insulation requirements are addressed by balancing insulation material capabilities against efficiencies, ease of installation and costs involved for varying strategies.

Blown insulation techniques, utilizing natural or synthetic particles or fibers have proven successful in many construction applications and scenarios. But whereas blown insulation is often chosen due to its cost effectiveness and insulating properties, some installations become labor intensive when masking screens or film need careful installation, using many fasteners upon exposed framing studs or members within a building assembly such as walls, floors, ceilings and roofs.

All of the foregoing areas are improved with the subject design which utilizes an apparatus for quickly, securely and efficiently affixing a film or web screen along the building assembly to be insulated with blown insulation. Typically for a wall assembly, the wall is panelized after the insulation is installed. In other assemblies, the insulation and web screen may be left exposed (e.g. attic installations).

SUMMARY OF THE INVENTION

The subject insulation system and method is designed to save labor while providing tighter and easier installation of fabrics used to contain blown-in insulation. Specially configured friction clip fastener tracks rely on the camber of legs or flanges and returns to provide a quick and efficient friction fit affording fast installation while greatly minimizing or nearly eliminating the need for mechanical fastening. By covering the entire face of the framing members there is no need to worry about insulation getting stuck between the fabric and the face of the framing, thereby minimizing bowing or buckling issues with subsequently installed drywall panels. Furthermore, tighter application of fabric (with the slight recesses created by the ¼ inch legs) limits the need for rolling the cavities flat after insulating, further reducing labor time and costs as well as call-back service calls from unsatisfied contractors or homeowners.

Another embodiment of the subject friction clip strip for metal studs provides a fast and easy application of fabrics on standard steel C-studs for blown-in insulation applications. Steel C-stud framing provides a unique challenge that until now has required either special equipment to spray in insulation or additional labor or framing to apply the fabric. The subject hooked leg design wraps around the return of the C-studs while the cambered leg provides an opposite snap-on friction fit. The friction clip strips for metal studs allows the insulation installer to apply insulation in areas they would have previously been unable to easily or efficiently implement.

In one embodiment of the present invention, masking screen material is applied across the faces of an array of framing studs and affixed to each stud with a suitable length of friction clip track. The subject friction clip is preferably an extruded length of material such as metal webbing or molded or extruded thermoplastic resin.

After the masking screen is affixed across the faces of the framing studs, the insulation may be blown into each cavity or void formed between parallel studs positioned perpendicularly upon an exterior wall or outside panel, wherein such cavity is enclosed by the screen masking film clipped to the outermost faces of the framing studs.

Each enclosed cavity is filled with blown insulation until all are filled. Thereafter the wall is finished with an outer panel such as gypsum wallboard thereby enclosing the insulation within the wall assembly, as desired or required.

The insulation system for installing blown-insulation in a variety of framed construction assemblies is described below. As used herein, framed construction assembly refers a variety of construction techniques for walls, ceiling and floor combinations or pitched roofing structures, all of which need adequate thermal insulation.

Taking a framed wall as an example assembly, an array of periodically placed and parallel first framing members are mechanically fastened to at least one perpendicular second framing member. That is, vertical studs are typically nailed or screwed to perpendicular framing members such as tracks. The framed wall then has a panel member fastened in a first plane to the first and second framing members thereby defining a generally rectangular or parallelepiped volume to be filled with blown-insulation (also referred to as blown-in insulation).

The subject insulation system comprises a generally rectangular masking screen configured to be affixed upon the exposed faces of the parallel first framing members in a second vertical plane opposite and parallel the panel member. That is, the masking screen covers the stud framing and is mechanically fastened to the exposed faces of the parallel framing members with a friction clip track.

The friction clip track is a linear segment track configured from a shaped planar web, the friction clip track having a length selected to match the length of the first parallel framing members (i.e. the wall height) and a track width selected to accommodate the exposed face of the parallel framing members. The shaped friction clip track further comprises a pair of opposite flanges depending from the track web, each flange having an inwardly angled return configured for frictionally engaging the masking screen to opposite sides of the parallel framing member. The flanges and returns can be configured or adapted to provide adequate friction for a variety of insulation applications. The clip track secures the masking screen between the track and the parallel framing member and thereby providing a generally parallelepiped enclosed volume to receive blown-insulation.

In typical applications, the system will further comprise one or more one-legged fastening tracks having lengths matching any unfastened peripheral edges of the masking screen. The fastening track is configured to seal the unfastened edges of masking screen thereby providing interior volumes ready for blown-insulation. The one-legged fastening track comprises a planar web of shaped track, typically metal or plastic, having a single flange depending from the web, the flange having a single return inwardly angled in the direction of the web. The fastening track is configured for mechanically fastening to a peripheral framing member, often with screws or nails, thereby securing the masking screen edges prior to installation of blown-insulation.

A typical framed construction assembly, such as a wall, will also have its array of parallel vertical studs mechanically fastened to conventional framing members such as an upper plate, a door or window header, a window sill or a lower plate. It will be recognized that door or window openings will also require sealing members at each side of the opening.

The system may also be utilized with a framed construction assembly comprising a floor and/or ceiling assembly having an array of parallel horizontal joists mechanically fastened to a plurality of perpendicular framing members, such as the plates atop a lower wall.

Similarly, the framed construction assembly is a pitched roof having an array of parallel vertical rafters mechanically fastened to perpendicular upper and lower framing members.

The friction clip track is configured from a shaped planar web of roll-formed or extruded metal or thermoplastic, the web having a width adapted to match the face of the complementary framing member and engaging the opposite flanges on either side edge of the framing member.

Typically the framing members are selected from wood, metal and engineered lumber framing members while the friction clip tracks and fastening tracks are metal or plastic.

The one-legged fastening tracks are configured to seal the unfastened peripheral edges of masking screen construction to additional framing members such as upper or lower plates, headers, sills, window or door sides and wall edges or corners. The flanges and inwardly angled returns are adapted to provide sufficient friction for securely fastening the fabric masking screen to the framing member.

The masking screen is selected from woven or unwoven fabric, plastic, paper and mesh masking screens.

The system described above may further comprise a thermal break strip fastened to the interior of the friction clip track or one-legged fastening track. The thermal break strip can be a length of solid or foam rubber or plastic, or paper, deployed between a friction clip track or one-legged fastening track. Typically, adhesive may be used to secure the thermal break to the track.

The insulation system can utilize blown-insulation selected from short fibers or particles of cellulose, sheep's wool, synthetic insulation fiber, blown fiberglass, loose denim and rock wools. Similarly, the blown-insulation is a mineral insulator selected from perlite and vermiculite.

An insulation system for installing blown-insulation in a framed construction assembly using parallel metal C-stud framing members is also provided herein. The parallel metal C-studs are mechanically fastened to at least one perpendicular second framing member and a panel member (such as exterior plywood sheathing) fastened in a first plane to said C-stud framing members and second framing members thereby defining a generally rectangular volume to be filled with blown-insulation. This insulation system comprises a generally rectangular masking screen configured to be affixed upon exposed faces of the parallel first framing members in a second vertical plane opposite and parallel the panel member, wherein the masking screen is mechanically fastened to the exposed faces of the C-stud framing members with a linear segment of a complementary friction clip track configured from a shaped planar web. The friction clip track has a length selected to match the length of the C-stud framing members and a width selected to accommodate the exposed face of the parallel C-stud framing members. The shaped friction clip track further comprises a first flange depending from the web, the first flange having an inwardly angled return configured for frictionally engaging the masking screen to one closed side of the C-stud framing member and a second flange and second return configured for mechanically engaging the open-side interior of the metal C-stud framing member for frictionally securing the mask screen; thereby securing the masking screen between the parallel framing member and the friction clip track, thereby providing a generally parallelepiped volume to receive and contain thee blown-insulation.

Another framing technique can use I-beams as the parallel framing members. The I-beam framing members are conventionally fastened to a plurality of perpendicular second framing members and a panel member such as exterior sheathing fastened in a first plane to said I-beam framing members and second framing members thereby defining a generally rectangular volume to be filled with blown-insulation. This insulation system comprises a generally rectangular masking screen configured to be affixed upon exposed faces of the parallel I-beam framing members in a second vertical plane opposite and parallel the panel member, wherein the masking screen is mechanically fastened to the exposed faces of the I-beam framing members with a linear segment of a friction clip track configured from a shaped planar web, the friction clip track having a length selected to match the length of the I-beam framing members and a width selected to accommodate the exposed face of the parallel I-beam framing members, wherein the shaped friction clip track further comprises a pair of opposite flanges depending from the web, the flanges each having an inwardly angled return configured for frictionally engaging the masking screen to each opposite flange side of the I-beam framing member; thereby securing the masking screen between the parallel framing member and thereby providing a generally parallelepiped volume to receive blown-insulation.

In each of the aforementioned systems, the construction assemblies can be finished with panel, such as gypsum or similar sheathing, which can be applied to the insulated frames with minimal risk of bulging due to extraneous insulation between the panels and the framing members.

The friction clip track for fastening a blown-insulation masking screen to a corresponding construction framing member, comprises a length of shaped web having opposite flanges depending from the web, each flange having an inwardly angled return, wherein the width of the track web is adapted to accommodate the face of the construction framing member and the depending flanges and returns are adapted to frictionally fasten the masking screen to the corresponding framing member. The friction clip track is preferably comprised of extruded or roll-formed metal such as light gauge steel or extruded, roll-formed or thermoformed plastic.

Other objects, features and advantages of the present invention will be apparent when the detailed descriptions of the preferred embodiments of the invention are considered with reference to the accompanying drawings, which should be construed in an illustrative and not limiting sense as follows:

BRIEF DESCRIPTION OF THE DRAWINGS

FIG. 6*a* is a perspective view of a detail of the embodiment shown in FIG. 6.

DETAILED DESCRIPTION OF THE PREFERRED EMBODIMENTS

The subject apparatus is designed to facilitate the installation of blown insulation during construction of wall assemblies. In a typical embodiment, there is provided a length or strip of friction clip track configured to provide a tight grip along the opposite outer surfaces of a framing member such as a stud, thereby maintaining tension on a masking screen, film or web of netting thereby affixed to an array of studs. The masking film, or netting, arrayed in such manner thereby defines a plurality of voids or cavities which are thereafter filled with blown insulation and then finished with wall paneling, or left exposed as desired or required.

The friction clip tracks or strips are designed to complement conventional framing members. Thus, one embodiment described below is suitable for a solid stud such as lumber or polymer; other embodiments are designed to be affixed to light steel framing members such as C-studs, I-beams and similar profiles.

Figure 1:
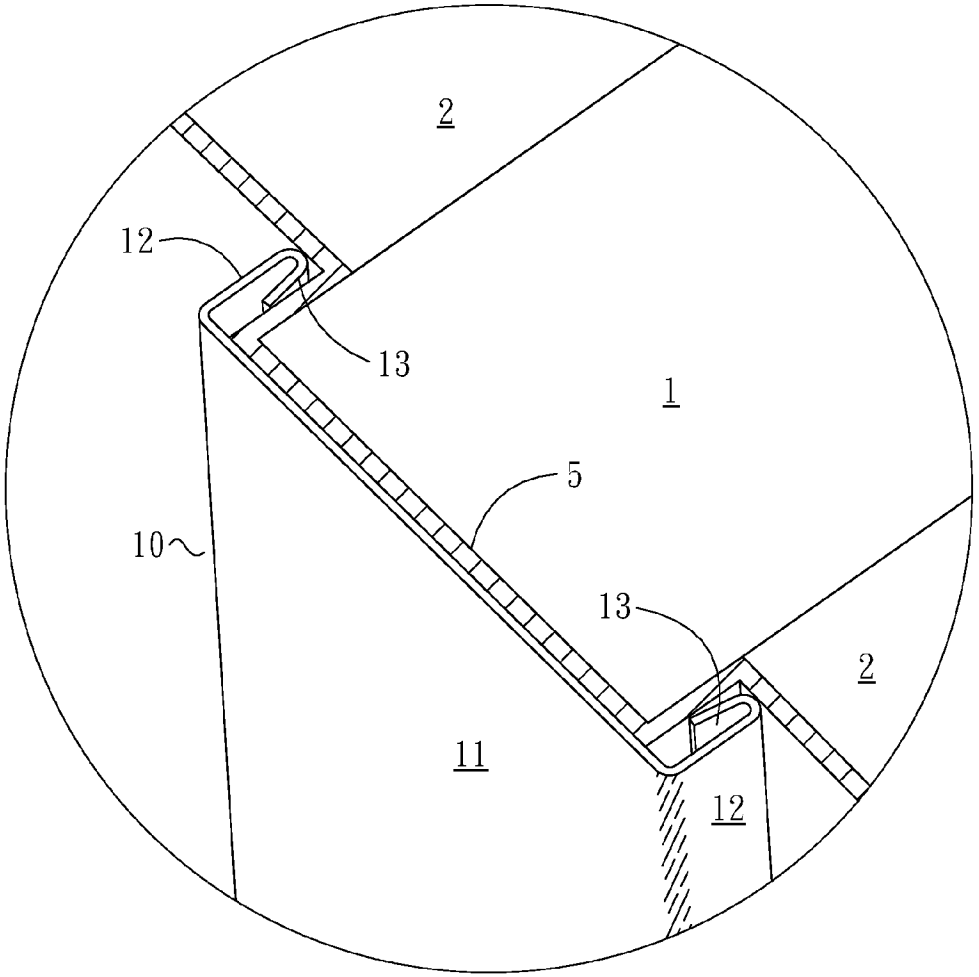
FIG. 1 is a perspective detail view of an embodiment of the subject apparatus.

In FIG. 1, a perspective detailed view of the apparatus can be seen. As part of the framing of a wall, a wooden stud 1 is often used, leaving an empty cavity 2 on each side of the stud. When preparing to blow insulation into the empty cavities of the wall, a front surface must be set up to keep the insulation in place prior to the finishing of the wall with drywall, or the like. A film of masking screen or netting 5 may be rolled across the wall, and is held tautly in place by a strip of friction clip track 10 thereby using friction to grip the sides of stud 1. The strip 10 has a face 11 with a 90-degree bend on each side, such that the strip wraps around the sides of the stud 1 and forming flanges 12 on each side. The flanges 12 of the strip each have a 180-degree inward bend forming returns 13. The returns 13 are spring-like projections that permit the legs 12 of the friction clip strip 10 to securely grip the sides of the wall stud 1, thereby holding the masking screen 5 in place. It will be recognized that other fasteners may be utilized in the subject insulating system including glues and pressure sensitive adhesives and tapes, as well as mechanical means such as screws, nails, staples, brads and the like.

Figure 2:
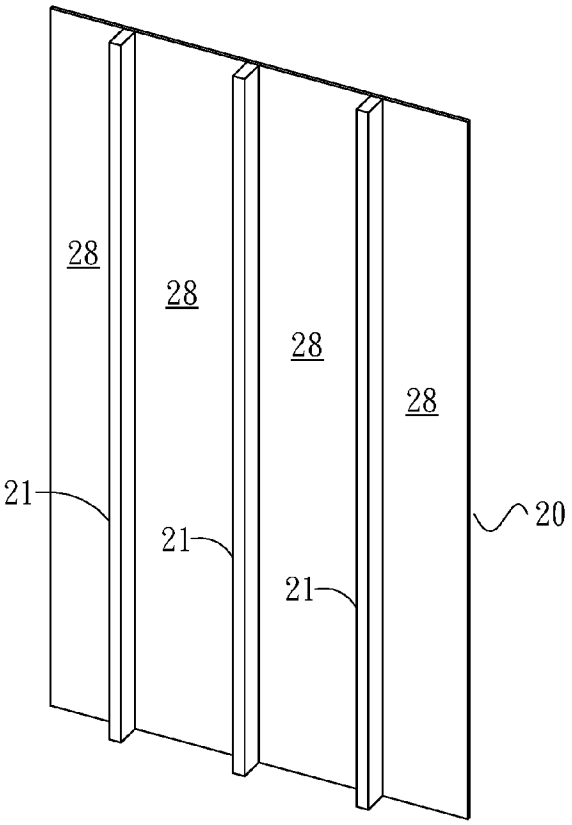
FIG. 2 is a perspective view of the interior of a section of wall.

In FIG. 2, the interior of a section of a conventional framed wall 20 is shown, having exterior wall or sheathing panel 28 and vertical wooden studs 21.

Figure 3:
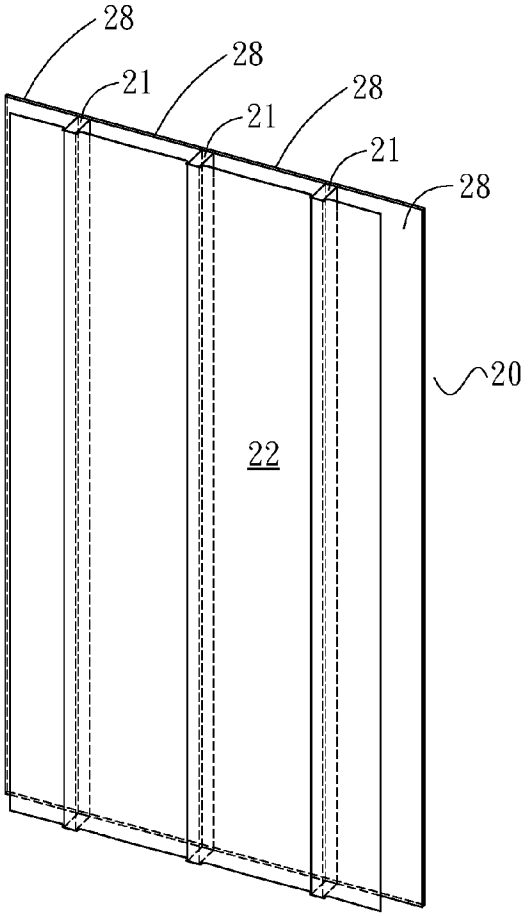
FIG. 3 is a perspective view of the section of wall of FIG. 2 showing mask netting utilized in some embodiments of the subject insulating system.

In FIG. 3, the wall frame 20 of FIG. 2 is shown again, but has the additional layer of masking screen 22 in place, covering the studs. The masking screen typically comes in rolls so that the length of netting may be unrolled and cut at desirable lengths. In the current application, it will be unrolled and placed up against the interior side of the wall studs in an exterior wall.

Figures 4, 4A:
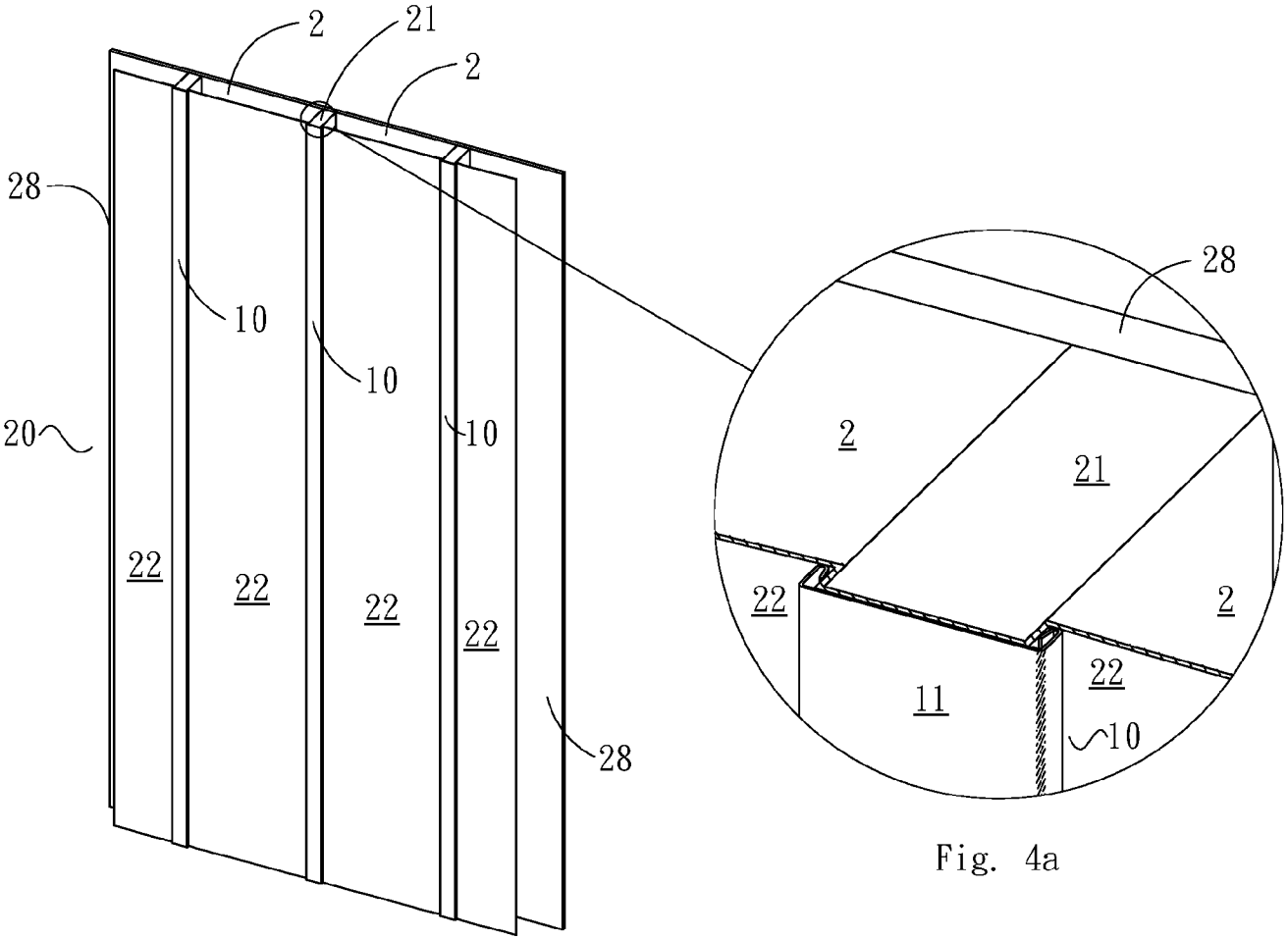
FIG. 4 is a perspective view of the section of wall of FIG. 2 showing the netting held in place by an embodiment of the subject apparatus.
FIG. 4*a* is a detailed view of a portion of FIG. 4.

In FIG. 4, the wall frame 20 of FIG. 2 is shown, with the masking screen 22 held in place by the friction clip tracks 10 as discussed in conjunction with FIG. 1. In some applications, the friction strips may be additionally secured in position with mechanical fasteners such as screws, brads or nails; as well as the aforementioned adhesives. The void or cavity 2 for receiving and containing the blown insulation is formed between the exterior wall 28 and the netting 22, and between a pair of parallel framing studs 21.

In preferred applications of the subject insulating method, a slit will be made in the masking screen to accommodate a wand or delivery tube or hose, inserted into the cavity to be insulated.

In FIG. 4*a*, a detailed view of the top of the wall section 20 of FIG. 4 is seen and is substantially the same as the view in FIG. 1. Here stud 21 is attached to exterior wall layer 28, masking screen 22 is rolled across the front of the stud 21, friction clip track 10 having face 11 is affixed over the netting 22 onto stud 21 thereby holding the masking screen 22 in place and creating voids 2 between the layer of wall 28 and netting 22 and studs 21.

Figures 5, 5A:
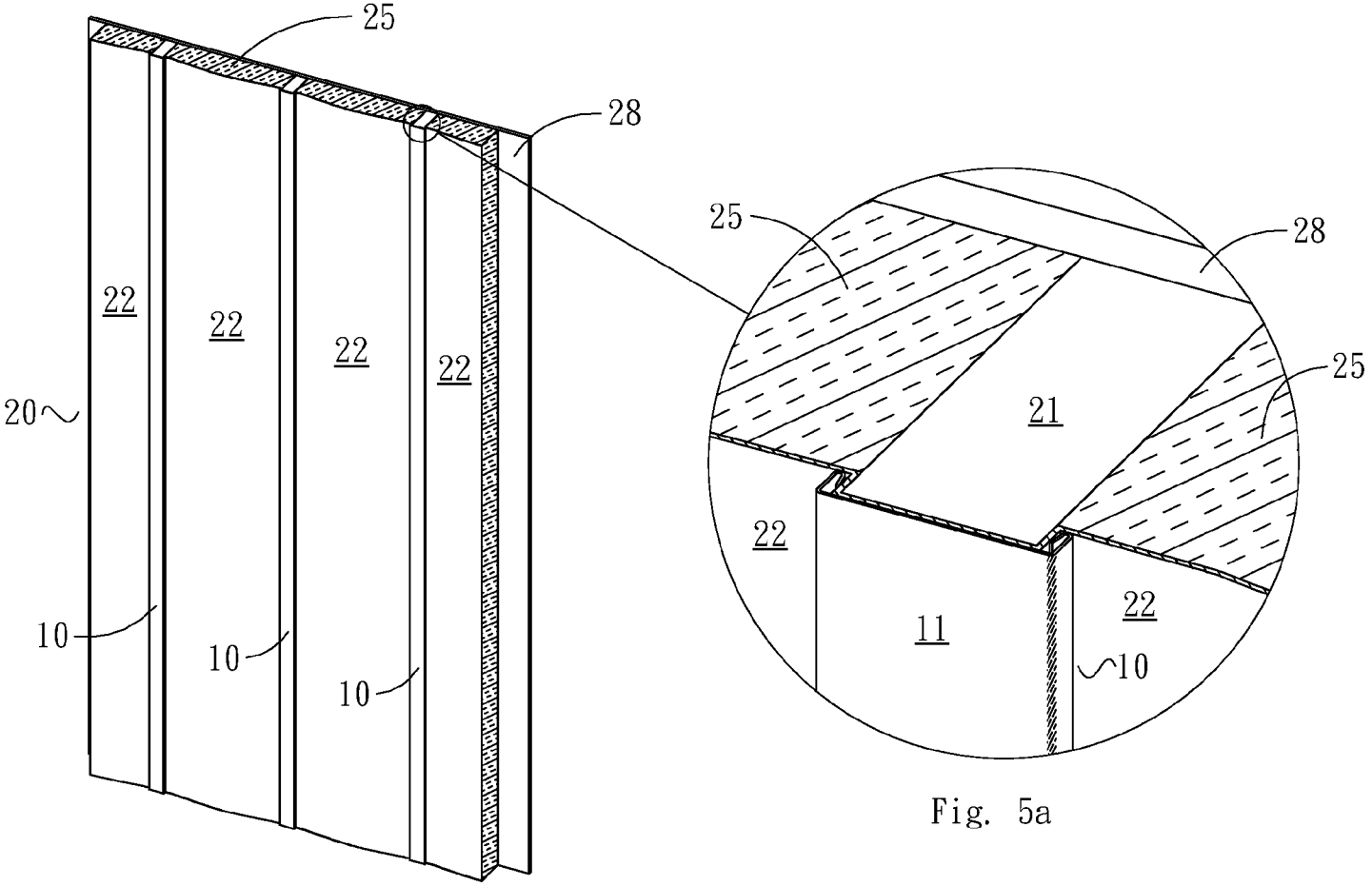
FIG. 5 is a perspective view of the section of wall of FIG. 2 showing the netting held in place by an embodiment of the subject apparatus and filled with insulation.
FIG. 5*a* is a detailed view of a portion of FIG. 5.

In FIG. 5, the same wall frame section 20 of FIG. 2 is shown, and the insulation 25 has been blown into the cavity formed between the exterior wall panel 28, the masking screen 22 and the vertical framing members 21.

In FIG. 5*a*, a detailed view of the top of the wall section 20 of FIG. 5 is shown and displays the blown insulation 25 filling the cavities on each side of the vertical framing member 21, between the exterior wall panel 28 and the masking screen 22. In this view, the friction clip track 10 is shown gripping the sides of the vertical framing member 21 thereby securing the masking screen 22 between the vertical framing member 21 and the face of the friction clip track 11.

Figure 6:
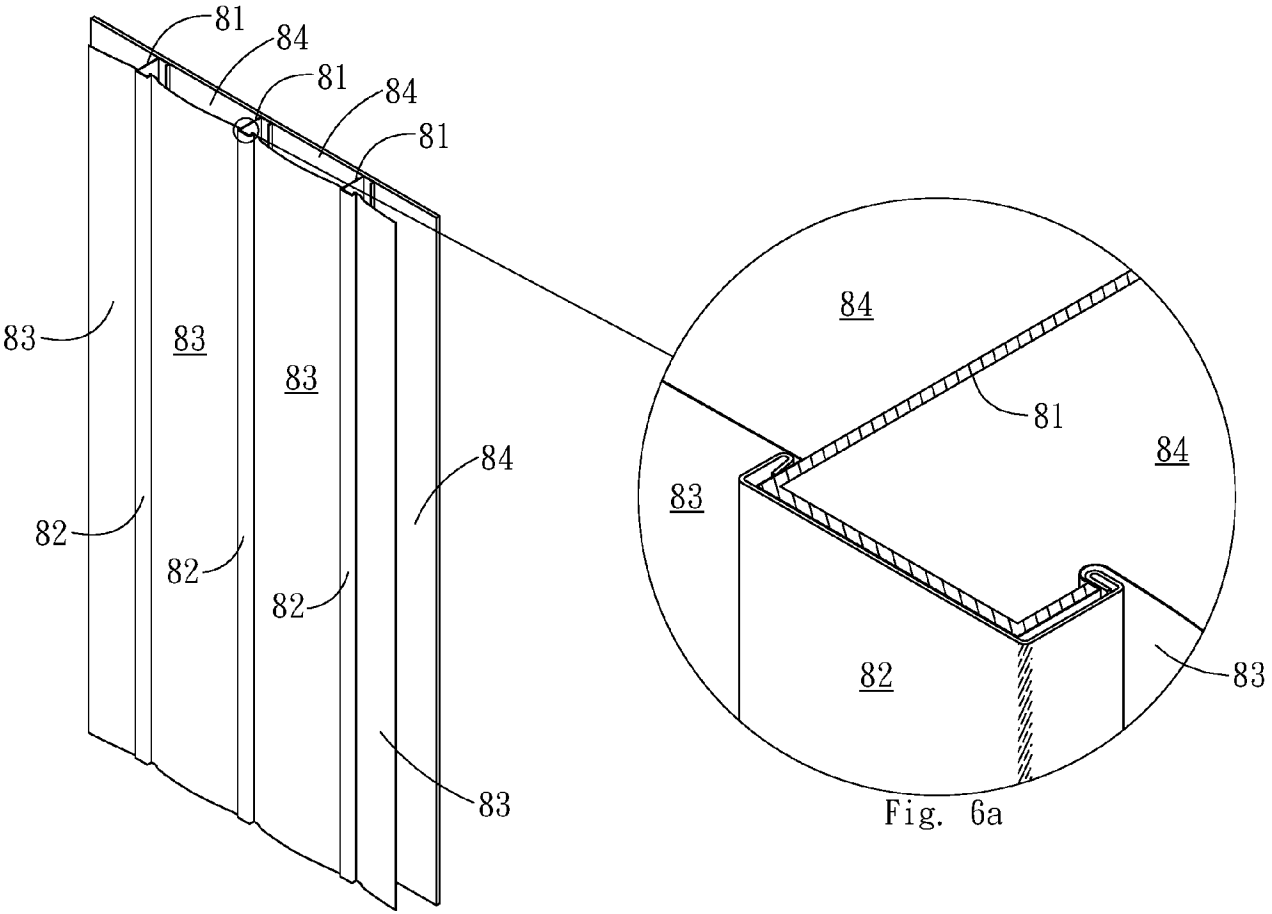
FIG. 6 is a perspective view of an alternate embodiment of the subject apparatus.

In FIG. 6, an alternative embodiment of the subject invention is shown. This embodiment is designed to cooperate with metal construction studs that have a C-shape cross-section or profile, rather than the solid rectangle shape of a wooden stud. Here, the metal stud 81 creates cavities 84 on each side into which insulation may be blown. The masking screen 83 is rolled across the exposed side of the C-studs and is held tautly in place by friction clip tracks 82. In FIG. 6*a* is depicted a detailed view of the friction clip track 82 having a web face and two 90-degree bends forming flanges depending from the web. One 0.25 in. flange has a 180-degree bend forming a 0.125 in. return. The opposite flange has a 90-degree bend forming a hook and then another 90-degree bend to form a return. Friction clip track 82 having one leg and an opposite hook and return are configured to grasp onto the flange of the C-stud, thereby fastening the masking screen onto the C-stud shaped framing member. In some applications, the friction clip track may be secured by the clips; in others mechanical fasteners may be added.

Figures 7, 8, 8A, 8B:
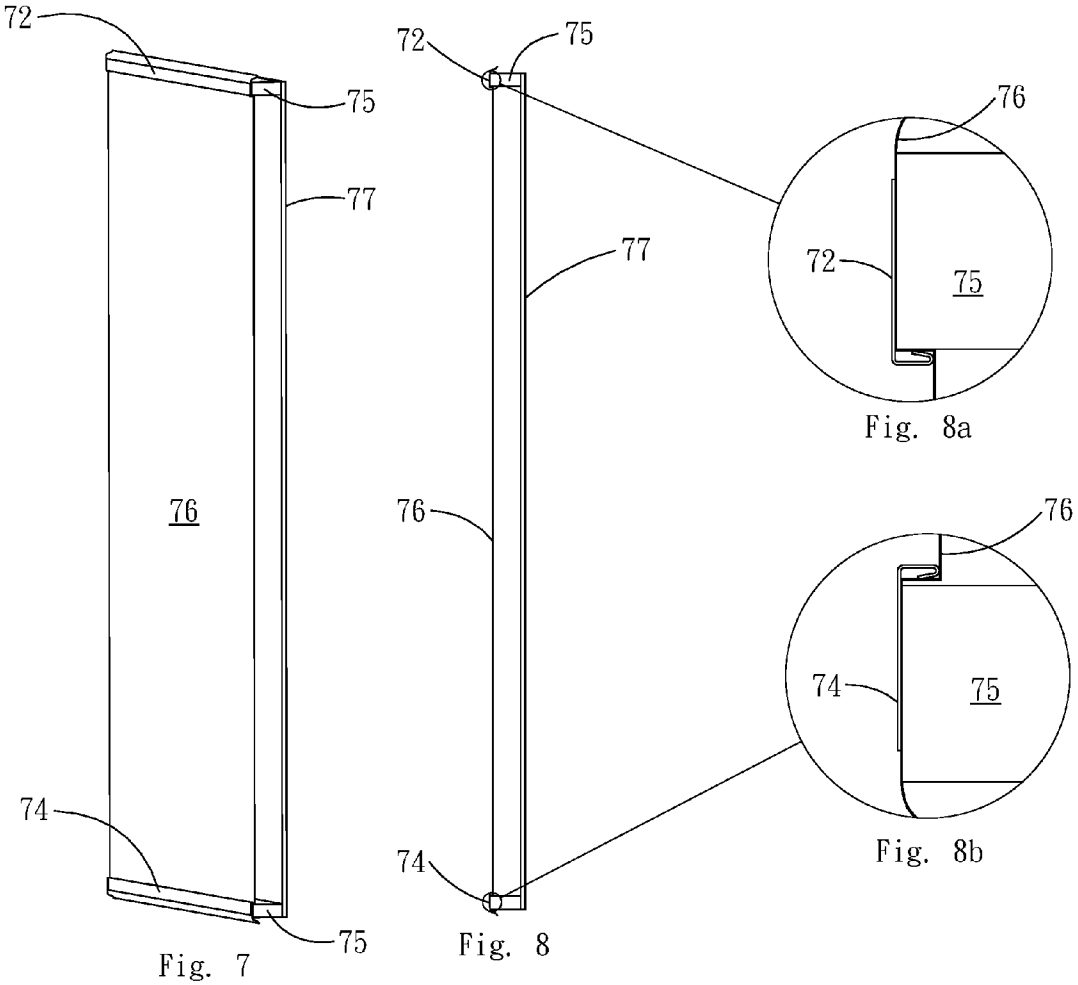
FIG. 7 is a perspective view of an alternate embodiment of the subject design having additional features.
FIG. 8 is a cross-sectional view of the embodiment shown in FIG. 7.
FIG. 8*a* is a detailed view of the top portion of the embodiment shown in FIG. 8.
FIG. 8*b* is a detailed view of the bottom portion of the embodiment shown in FIG. 8.

In some installations, it will be necessary to further seal the masking screen to the framing members so that blown-insulation does not leak out of the unsealed edges of a cavity being filled. FIG. 7 depicts a perspective view of a section of a wall having an exterior wall panel 77 and top and bottom plates 75. In order to seal the top of the masking screen to the top plate 75, a modified one-legged fastening track 72 having one leg runs horizontally across and is mechanically affixed to the top plate 75, holding the masking screen 76 tautly in place. Similarly, an additional length of one-legged fastening track 74 is mechanically affixed to the bottom plate 75, holding the masking screen 76 tautly in place. The one-legged tracks 72 and 74 may be secured to the top and bottom plates using glue or adhesive or any suitable mechanical means including screws, nails, brads, staples and the like.

These upper and lower tracks will generally have a single leg running lengthwise along the strips and are especially adapted for use along top and bottom edges of a wall construction, and may also be used as interior edges for wall corners and window or door openings thereby preventing loss of blown insulation in these areas. In preferred embodiments, these upper and lower modified strips are used in combination with the above-described two-legged friction clip tracks, thereby holding the screen mask taut on the plane of the wall and ensuring blown insulation does not escape the top or bottom of the independent cavities, nor billow onto the faces of the various framing members.

In FIG. 8, a cross-sectional view of the embodiment shown in FIG. 7 is depicted, showing the exterior wall panel 77, the top and bottom plates 75 and the masking screen 76 held in place by upper track 72 and lower track 74.

FIG. 8*a* is a detailed side view of the top portion of the embodiment shown in FIG. 8. In this view, the one-legged fastening track 72 is shown holding the masking screen 76 against the top plate 75.

FIG. 8*b* is a detailed side view of the lower portion of the embodiment shown in FIG. 8. In this view, the one-legged fastening track 74 is shown holding the masking screen 76 against the bottom plate 75.

One-legged friction clip tracks are modified versions of the above-described two-legged friction clip tracks. It should be recognized that the one-legged fastening tracks can be fabricated by utilizing the above-described symmetrical friction clip tracks and cutting, splitting or stamping them longitudinally along the web at an equal distance between the flanges.

One-legged tracks are useful to complete construction assemblies and can be used for top and bottom plates, end studs, corner studs, around windows and doors, thereby providing a complete insulating system. One-legged finishing tracks are used at the top and bottom of each stud bay or cavity to hold the masking screen tight while preventing insulation from blowing out during the application and installation process. Additionally, the one-legged tracks are used on end or corner studs, as well as around windows and doors.

Figure 9:
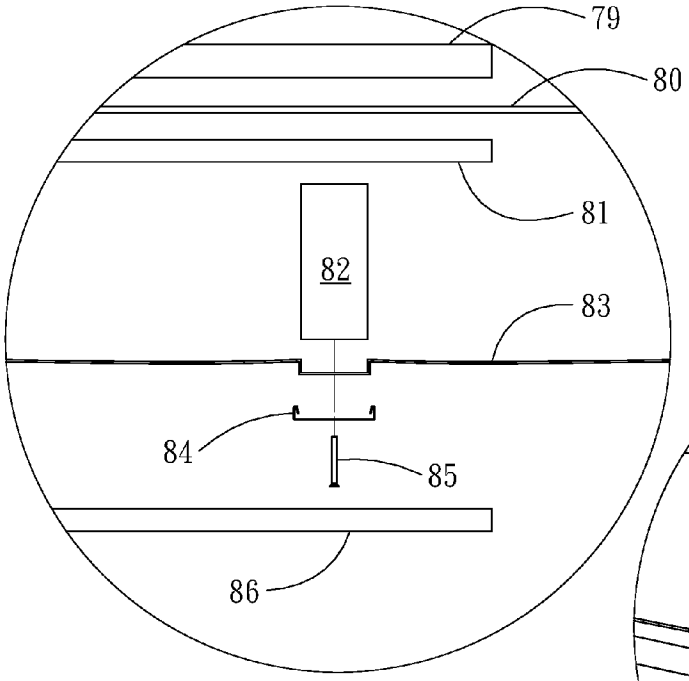
FIG. 9 is an exploded top view of a wall assembly showing the layers of parts in the subject system.

FIG. 9 is an exploded top view of a wall assembly showing the layers of parts in the subject system. In a complete wall assembly, there may be various layers of paneling, insulation, siding and finishing layers as desired for utility and aesthetics. In a typical assembly utilizing the subject blown-insulation system, there will be an outer layer 79, which may be any exterior finishing layer including bricks, cedar shakes, vinyl or cedar siding, or the like. Typically there is also a vapor barrier layer 80, such as TYVEK® sheet material, which is affixed to exterior paneling layer 81, which may be fiberglass, plywood, oriented strand board (OSB) or the like. The construction framing member 82 may be a solid wooden stud, or alternatively may be a light gauge steel stud such as a C-stud or I-beam. The masking screen 83 will be rolled across the framing member 82, and will be held tightly in place by friction clip track 84. This view shows the optional mechanical fastener 85 which may be a screw, nail, staple or any other suitable fastening means. Finally, after filling the cavities with blown insulation, the wall assembly may be finished by installing the interior panel layer such as gypsum wall board.

Figure 10:
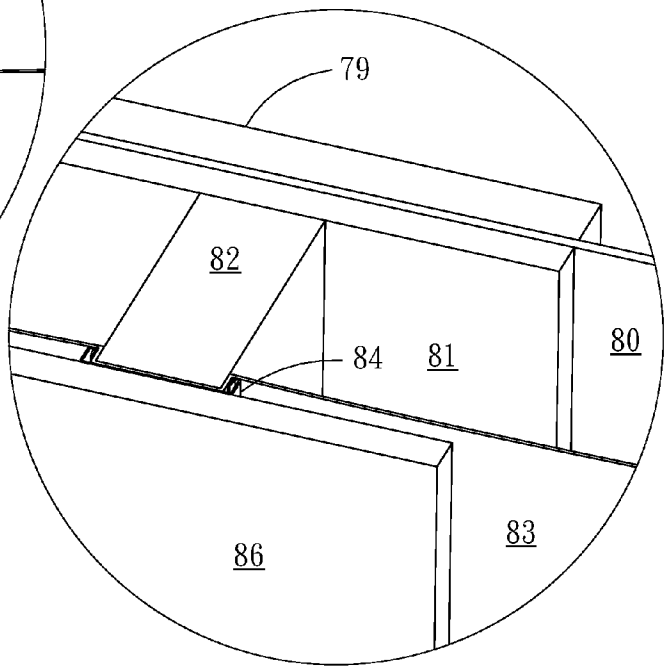
FIG. 10 is a perspective view of the assembly of FIG. 9 as assembled.

FIG. 10 is a perspective view of the assembly described in FIG. 9, as assembled.

Figure 12:
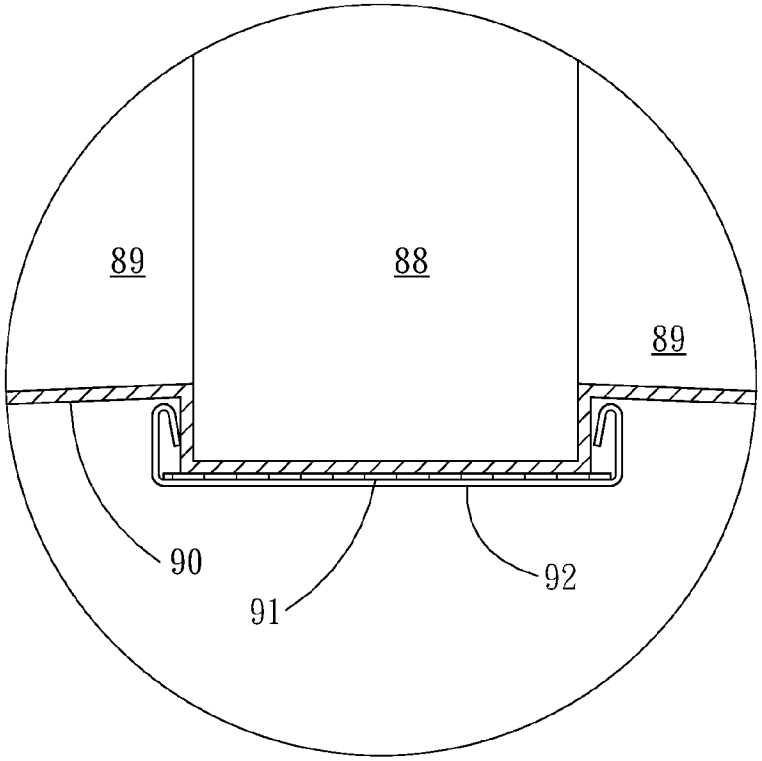
FIG. 12 is a top view of the embodiment shown in FIG. 11.
Figure 11:
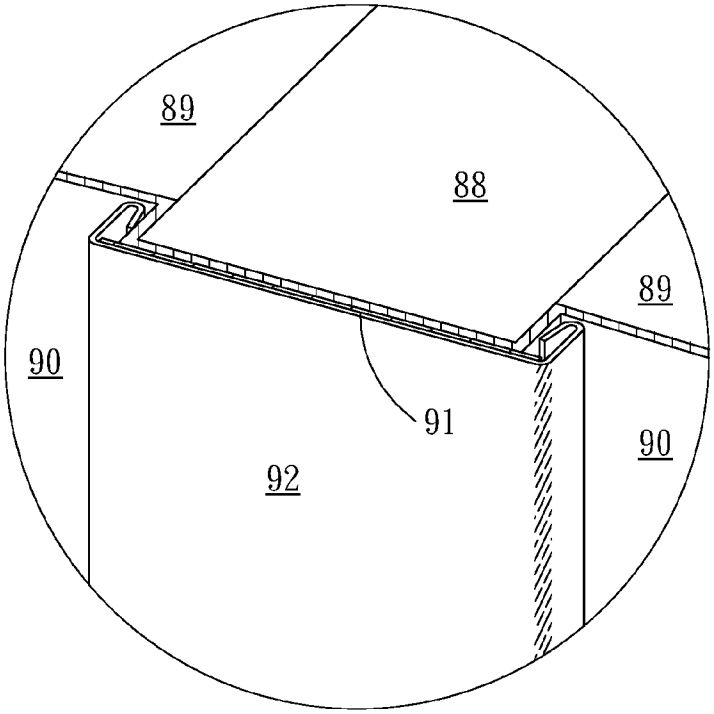
FIG. 11 is a perspective view of an alternative embodiment of the subject apparatus.

In an alternative embodiment, the friction clip track has a thermal break applied along the interior face of the track, so that it is layered between the friction clip track and the masking screen when affixed to a construction framing member. Thermal break 91 is depicted in FIGS. 11 and 12, layered between the face of the friction clip track 92 and the masking screen 90. The friction clip track 92 is fastened to the framing member 88 tightly holding masking screen 90 in a vertical plane against the vertical framing member 88 and forming cavities 89. The thermal break 91 is an insulating strip of foam, rubber, plastic or treated paper that may be fastened or adhered to the interior web of the friction clip track. The thermal break provides additional insulting properties to a wall or ceiling construction, especially at the locations of each framing member where blown insulation typically cannot be readily installed.

Figure 13:
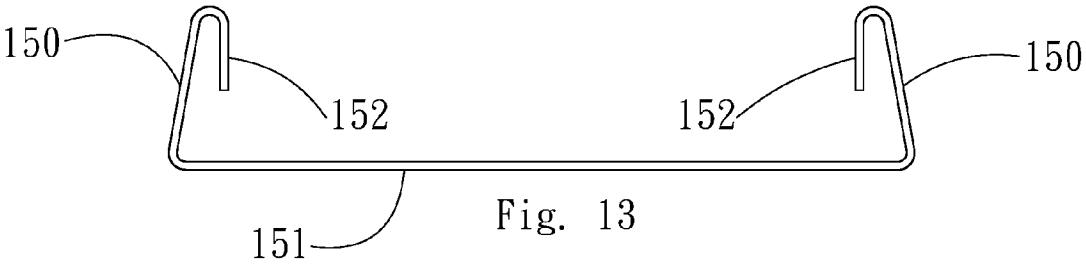
FIG. 13 is a cross-sectional view of one embodiment of the subject friction clip.
Figure 14:
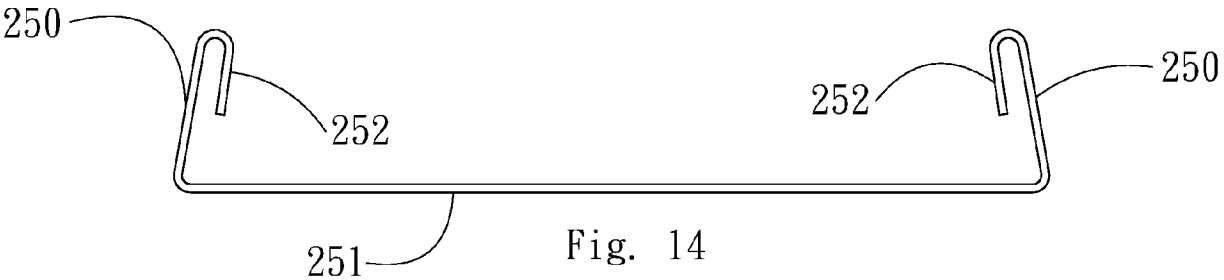
FIG. 14 is a cross-sectional view of an alternative embodiment of the subject friction clip.
Figure 15:
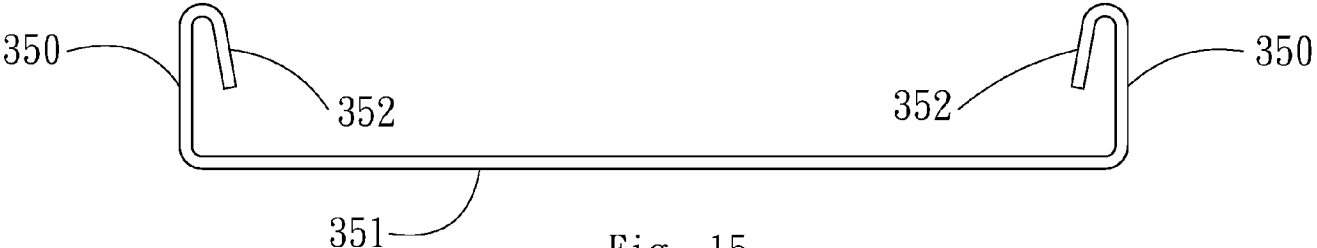
FIG. 15 is a cross-sectional view of an alternative embodiment of the subject friction clip.

FIGS. 13, 14, and 15 show profiles of three examples of preferred embodiments of the subject friction clip track. In FIG. 13, the web 151 has two flanges 150 depending therefrom, each flange angled towards the center of the web and having a return 152 further angled towards the center of the web. In FIG. 14, the web 251 has two flanges 250 depending therefrom, each flange angled towards the center of the web and having a return 252 parallel to the flange 250. In FIG. 15, the web 351 has 2 flanges 350 depending perpendicularly therefrom, each flange having a return 352 angled towards the center of the web 351.

It will be recognized than many combinations of angles of flanges and returns may be possible without departing from the spirit of the invention. Each can be varied to provide adequate friction needed in various insulation applications.

In a typical embodiment, a one-legged track will have approximately a 1 inch face with a 90 degree bend into a 0.25 inch flange with a 180 degree 0.125 inch return. The flange and return also provides a stiffening quality to the friction clip track while holding the masking screen tight and preventing insulation from blowing onto the face of wall framing.

For lumber framing applications, nominal 2×4 wood studs may be utilized. These typically have a face width of about 1.5 in. and the friction clip track will have a web width of about 1⅝ in. to accommodate fluctuations in the wood stud.

The flanges of the friction clip track will be about 0.25 in. long with a 0.125 in. return. The flanges preferably will be cambered in to create a friction fitting, that is, a snap-in-place design, holding the masking screen tight while tracks are fastened.

As mentioned above, modified friction clip tracks having a single flange or one-leg are used for top and bottom plates, jack stud headers, end wall studs or anywhere that will not accommodate the above described 2 flanged friction clip tracks. Used together, these two types of tracks will be sufficient to provide or facilitate an insulating system suitable for many building applications.

Typically, the face width of the friction clip in this embodiment will be about 1⅜ in. so that it does not overlap the edge of a lumber stud. The single leg or flange depending from the friction clip will be 0.25 in. long with a 0.125 in. return and will be cambered inwardly to pull the netting screen tight as it is installed.

Framing studs may be constructed of wood, vinyl, or light gauge steel, as well as engineered lumber in conventional dimensions. A wide variety of the subject friction clip tracks may be applied in complementary fashion as may be required. One example of such track will utilize a 1.625 in. face having 1.25 in. flanges.

The subject insulating system can be utilized with engineered lumber construction techniques such as those incorporating laminated veneer lumber (LVL) such as those manufactured by TJI or Georgia Pacific LVL suppliers. Face sizes of friction clip tracks used with LVL framing members will be 0.25 in. wider than the face of the selected LVL or wood studs or I-beams. Legs or flanges will be same as on tracks for traditional lumber with 0.25 flange and 0.125 return, and both legs will be cambered in to create a "snap on" fit while holding a masking screen tight.

Modified friction clip tracks for engineered lumber are designed to work with the LVL's and wood I-beams that are used in many construction projects. The wide faces of engineered lumber products may require additional fastening to prevent insulation from getting caught between the fabric and the face of the LVL's and wood I-beams. The full face coverage of friction clip tracks ensures that the insulation stays in the cavity. The snap-on design facilitates use in difficult overhead and sloped webbing applications. Friction clip tracks for engineered lumber are designed to accommodate all of the common wood I-beam and LVL's used in today's construction. These tracks have all of the features of the earlier described two legged tracks, but with face dimensions to fit the specific widths of LVL's and wood I-beams. Friction clip tracks for engineered lumber generally will have two 0.25 in. legs with 180 degree returns that are cambered-in to provide a friction fit, thereby fastening the screen mask to the engineered lumber member prior to insulation.

The subject method and apparatus may be used in a wide variety of construction applications. In typical room insulation applications, a wall may be 7 ft to 12 ft. in height commonly utilizing 2×4 or 2×6 dimensional framing studs, each having 1½ inch faces (widths). Such walls can have nearly any width.

In typical applications, framing studs will be installed with 16 in. or 24 in. on-center spacing. It will be recognized that extra width reduces thermal bridging in certain insulating applications.

A variety of masking screen materials may be utilized. One preferred woven web material is HANES INSUL-WEB™ polypropylene fabric, available in 8 to 10 ft rolls of 375 or 750 feet length.

The masking screen or is typically about 0.27 mm thick. It needs to exhibit sufficient strength to maintain shape and hold insulating contents but not be so thick as to interfere with installation or subsequent panelization of the building assembly.

Alternative screen webs are TYVEK® brand non-woven barrier or TYPAR™ weather barrier rolls or 6 mil polyethylene sheeting.

In practice, it is preferred that the roll seams are overlapped by about 6 to 12 in. to minimize blow-out of insulating material.

A wide variety of materials may be utilized to provide the subject friction clip tracks. Thermoplastic polymer resin extrusions of vinyl, polyolefins such as polyethylene and polypropylene and the like may be utilized, as well as blends of these. Also metal webs may be roll-formed to provide friction clip strips exhibiting appropriate profiles effective for holding the screen mask in other applications. These each may be chosen based on factors such as cost, availability and performance characteristics for particular applications. A variety of extruded profiles may be utilized in conjunction with complementary framing studs, headers, footers, tracks and plates.

Methods of fabrication can include the aforementioned extrusion molding as well as cold rolled fabrication of plastic or metal webs. Metals such as steel or aluminum may be roll-formed or extruded and are preferred in certain applications.

The friction clip strips are capable of affixing the web masking screen with friction alone or may be mechanically affixed for extra security. Screw fasteners are typically used in such instances, as may be nails, staples or brads. As mentioned previously, chemical fasteners such as glue and adhesives may be used in some applications. Duct tape may also be used.

The insulating fill may be selected from a wide variety of commercially available materials such as short cellulose fibers or particles, sheep's wool, all types of fiber insulation, blown fiberglass, loose denim and rock wools and other minerals such as perlite and vermiculite.

In typical embodiments, the cavity is vapor-open, to allow the transfer of moisture to the warm side of the wall. Vapor sealed applications are usually not utilized as this tends to entrap moisture. Often, the cavity is vapor-open, but air-sealed with a barrier such as dry wall. However, the subject system may also be utilized in an alternative vapor-sealed embodiment.

EXAMPLE

As an example of the subject insulating system there is provided an exterior wall panel construction assembly having interior vertical framing studs oriented perpendicularly to the outside sheathing, a woven web of screening mask covering the interior faces of the vertical framing members and held thereon with strips of friction clips described above which were applied to each framing stud face, each friction clip having perpendicular flanges frictionally clipped to opposite sides of the vertical studs. Thereafter, cellulose fiber insulting material was blown into each cavity defined by the studs, sheathing and masking screen. The wall assembly insulated in such fashion was then ready to be finished with an interior panel such as gypsum board.

The invention now being fully described, it will be apparent to one of ordinary skill in the art that many changes and modifications can be made thereto without departing from the spirit or scope of the invention as set forth herein.

The invention claimed is:

1. An insulation system for installing blown-insulation in a framed construction assembly having an array of periodically placed and parallel first framing members mechanically fastened to at least one perpendicular second framing member and a panel member fastened in a first plane to said first and second framing members thereby defining a generally rectangular volume to be filled with blown-insulation, the insulation system comprising:

a generally rectangular masking screen configured to be affixed upon exposed faces of the parallel first framing members in a second vertical plane opposite and parallel the panel member, wherein the masking screen is mechanically fastened to the exposed faces of the parallel first and perpendicular second framing members with a linear segment of a shaped friction clip track configured from a shaped planar web, the shaped friction clip track having a length selected to match the length of the first parallel first framing members and a width selected to accommodate the exposed face defined by the parallel first and perpendicular second framing members, wherein the shaped friction clip track further comprises a pair of opposite flanges depending from the shaped planar web, each flange having an inwardly angled return configured for frictionally engaging the generally rectangular masking screen to opposite sides of the first parallel first framing members thereby securing the generally rectangular masking screen between each first parallel first framing member and the shaped friction clip track; thereby providing at least one generally parallelepiped volume to receive blown-insulation; and further comprising one or more one-legged fastening tracks having lengths matching any unfastened peripheral edges of the generally rectangular masking screen, the one or more one-legged fastening tracks configured to seal any unfastened peripheral edges of the generally rectangular masking screen to additional framing members thereby providing one or more additional interior volumes ready for receiving and containing blown-insulation and thereby providing a plurality of defined volumes to receive blown-insulation.

2. The system of claim 1, wherein the one or more one-legged fastening track comprises a planar web of shaped track having a single flange depending from the planar web, the single flange having a single return inwardly angled in the direction of the planar web, the one or more one-legged fastening track configured for mechanically fastening to a peripheral framing member thereby securing the generally rectangular masking screen edges prior to installation of blown-insulation.

3. The system of claim 1 wherein the additional framing members are comprised of upper or lower plates, headers, sills, window or door sides and wall edges or corners.

4. The system of claim 1 further comprising a thermal break strip fastened to the interior of the shaped friction clip track or one or more one-legged fastening track.

5. The system of claim 1 wherein the framed construction assembly is a wall having an array of parallel vertical studs mechanically fastened to at least one of an upper plate, a door or window header, a window sill or a lower plate.

6. The system of claim 1 wherein the framed construction assembly is a floor and ceiling assembly having an array of parallel horizontal joists mechanically fastened to a plurality of perpendicular framing members.

7. The system of claim 1 wherein the framed construction assembly is a pitched roof having an array of parallel vertical rafters mechanically fastened to perpendicular upper and lower framing members.

8. The system of claim 1 wherein the shaped friction clip track is configured from a shaped planar web of roll-formed or extruded metal or thermoplastic, the shaped planar web having a width adapted to match the face of the parallel first and second framing members and engaging the pair of opposite flanges on either side edge of the parallel first and second framing members.

9. The system of claim 1 wherein the parallel first and second framing members are selected from wood, metal and engineered lumber framing members.

10. The system of claim 1 wherein the pair of opposite flanges and inwardly angled returns are adapted to provide friction for securely fastening the generally rectangular masking screen to the parallel first framing member.

11. The system of claim 1 wherein the generally rectangular masking screen is selected from woven or unwoven fabric, plastic, paper and mesh masking screen.

12. The system of claim 4 wherein the thermal break strip is a length of solid or foam rubber or plastic, or paper, deployed between the shaped friction clip track or the one or more one-legged fastening track.

13. The system of claim 1 wherein the blown-insulation is selected from short fibers or particles of cellulose, sheep's wool, synthetic insulation fiber, blown fiberglass, loose denim and rock wools.

14. The system of claim 1 wherein the blown-insulation is a mineral insulator selected from perlite and vermiculite.

* * * * *